United States Patent [19]

Mayne

[11] Patent Number: 4,874,087

[45] Date of Patent: Oct. 17, 1989

[54] PAINT BRUSH HOLDER

[75] Inventor: James K. Mayne, Southwick, Mass.

[73] Assignee: American Brush Corporation, Claremont, N.H.

[21] Appl. No.: 169,739

[22] Filed: Mar. 18, 1988

Related U.S. Application Data

[63] Continuation of Ser. No. 776,212, Sep. 16, 1985, abandoned.

[51] Int. Cl.[4] ..... B65D 83/10

[52] U.S. Cl. ..... 206/362.4; 206/361

[58] Field of Search ..... 206/361, 362, 362.1, 206/362.2, 362.3, 362.4; 229/27

[56] References Cited

U.S. PATENT DOCUMENTS

| | | | |
|---|---|---|---|
| 2,038,845 | 4/1936 | Locke, Jr. . | |
| 2,763,367 | 9/1986 | Schumann . | |
| 2,956,676 | 10/1960 | Dgetluck | 206/361 |
| 3,077,978 | 2/1963 | Krzyzanowski et al. . | |
| 3,111,253 | 11/1963 | Hennessey . | |
| 3,241,738 | 3/1966 | Freiman . | |
| 4,053,050 | 10/1977 | Forbes, Jr. et al. . | |
| 4,170,298 | 10/1929 | Dorn . | |
| 4,413,730 | 11/1983 | Morse | 206/232 |

*Primary Examiner*—Joseph Man-fu Moy

*Attorney, Agent, or Firm*—Wolf, Greenfield & Sacks

[57] ABSTRACT

A paint brush holder and display device embodying first and second pockets for receiving, respectively, in suspension a paint brush and a card bearing instructions for use in maintenance of the brush.

3 Claims, 2 Drawing Sheets

PAINT BRUSH HOLDER

This application is a continuation of application Ser. No. 776,212, filed Sept. 16, 1985, now abandoned.

BACKGROUND OF THE INVENTION

Paint brush holders and display devices are disclosed in various forms in U.S. Pat. Nos. 2,831,573; 2,956,676; 2,963,150; 3,035,693; 3,077,978; and 4,207,977. In all instances, the holders are structured exclusively for supporting the brush for display and/or storage and for the further purpose of holding the bristles straight after the brush has been used and cleaned. It is the purpose of this invention to provide a holder which not only provides for display and storage, but also includes a pocket for receiving a card bearing instructions for use and maintenance of the brush and which embodies the foregoing in such form as to enable readily die-cutting and forming the structure for use.

SUMMARY OF THE INVENTION

As herein illustrated, the display device for holding paint brushes is structured to define a first holder for receiving a brush, a second holder for receiving a card bearing instructions for use of the brush, said second holder comprising first and second coextensive, elongate, rectangular panels connected throughout their longitudinal edges to each other and separable therebetween so as to define a first pocket for slidingly receiving the card, said first holder comprising a third rectangular panel mounted to the face of one of the first and second panels, said third panel being narrower in width and shorter in length than said panels and being positioned with its edges symmetrically spaced from said edges of the panels and with its ends spaced from the ends of the panels with one end at a greater distance than the other from the ends of the first and second panels and in spaced, parallel relation to the panels so as to define therewith a second pocket for receiving the brush, a ledge at the inner side of the third panel at the lower edge for engagement with the ferrule of the brush to suspend the brush and an aperture in the third panel at the top to expose the bristles of the brush for inspection.

The invention will now be described with reference to the accompanying drawings, wherein.

Paint brushes are now an expensive item and, hence, it is desirable to provide the customer with a brush holder that permits examination of the brush prior to purchase to make sure that it is appropriate for the intended use, to provide the customer with instructions for its use and maintenance, to provide the customer with suggestions for treatment of the surface to be painted preparatory to painting and to supply other helpful information. It is the purpose of this invention to provide such a brush holder in such form that it can be easily manufactured by simple die-cutting, gluing and folding operations.

Figure 1:
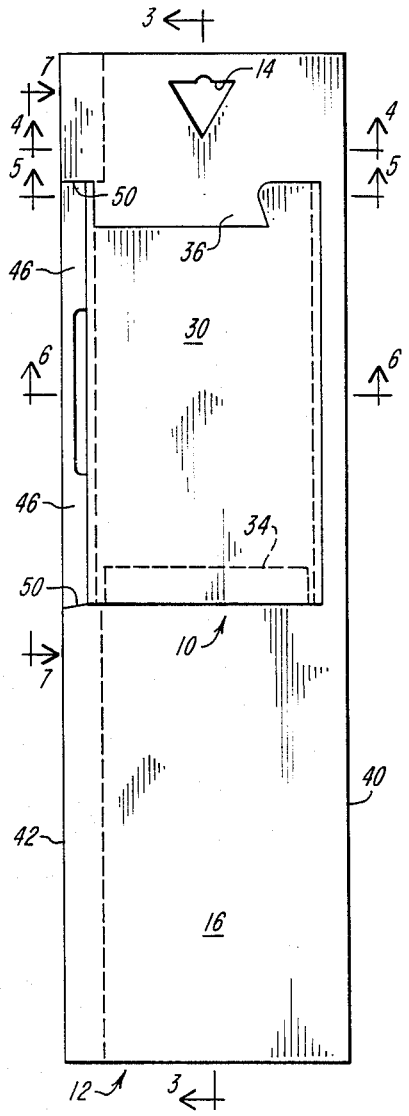
FIG. 1 is a plan view of the paint brush holder and display device according to this invention, showing a paint brush disposed therein.
Figure 2:
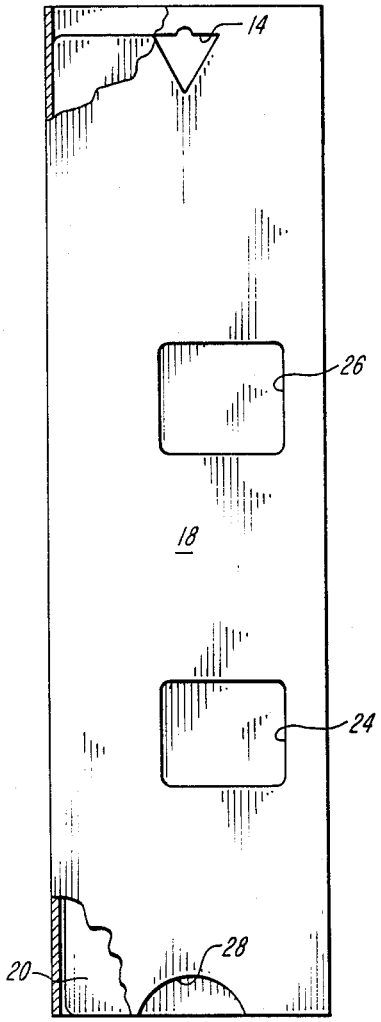
FIG. 2 is a plan view of the back side of the holder disclosed in FIG. 1.

Referring to the drawings, FIGS. 1 and 2, the paint brush holder as herein illustrated is structured to provide a holder 10 for a brush and a holder 12 for a card bearing information for the use and maintenance of the brush and such other information as would be useful to the user. The holder 10 is mounted to the holder 12 and the latter is provided with apertures 14—14 by means of which the holder may be suspended from a hook either for the purpose of display prior to sale or for the purpose of storage by the purchaser after use.

Figure 3:
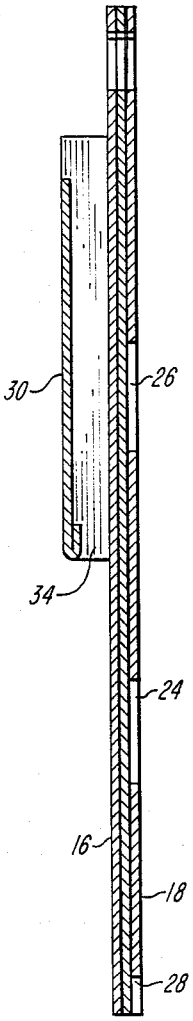
FIG. 3 is a section taken longitudinally of FIG. 1.
Figure 7:
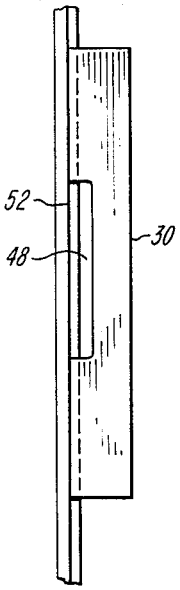
FIG. 7 is an elevation taken on the line 7—7 of FIG. 1.
Figure 9:
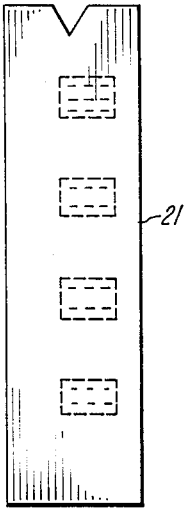
FIG. 9 is a plan view of the blank from which the holder is made.

More specifically, the card holder 12 is of rectangular configuration and comprises front and back panels 16 and 18, FIG. 3, joined along their opposite edges in face-to-face relation. The faces intermediate the edges are unjoined and define a pocket 20, FIGS. 4, 5 and 6, open at opposite ends for slidably receiving an elongate, rectangular card 21, FIG. 9, upon which is printed information pertinent to the use of the brush and to the painter. The back panel 18, FIG. 2, contains one or more window openings 24,26 through which may be seen information printed on the card, so arranged that by moving the card longitudinally within the pocket, different bits of information may be presented at the windows. A notch 28 at the lower end of the back panel 18 is provided to facilitate grasping the lower end of the card for the purpose of sliding it within the pocket.

Figure 5:
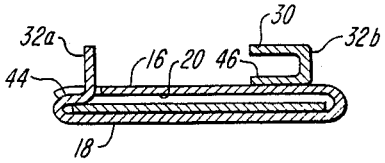
FIG. 5 is a section taken transversely of FIG. 1 on the line 5—5.
Figure 6:
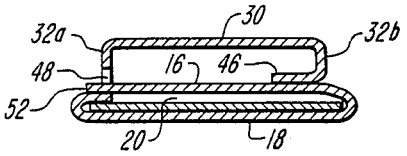
FIG. 6 is a section taken transversely of FIG. 1 on the line 6—6.

The brush holder 10 comprises a face board 30, FIGS. 1 and 6, of a transverse width less than the width of the panels 16 and 18 and shorter in length than the panels 16,18, positioned symmetrically with respect to the longitudinal edges of the panels 16 and 18 with its upper end spaced from the upper end of the panels and its lower end spaced from the lower end of the panels. Desirably, the positioning is such that when a paint brush is disposed in the pocket, as shown in dotted line, the handle of the brush will not extend beyond the lower end of the panels 16 and 18. The face board 30 is supported in spaced, parallel relation to the panels 16 and 18 in substantially parallel relation thereto at a distance corresponding substantially to the thickness of the brush by means of side boards **32*a*–32*b*, FIGS. 5 and 6, connected to the opposite edges thereof and to the face of the panel 16**.

A ledge in the form of a strip 34 is attached to the face panel 16 at the inner side adjacent the lower end for engagement with the ferrule of the brush when the latter is disposed within the pocket to support the brush within the pocket. At the upper end of the face board 30, there is a transverse aperture 36 which provides for exposure of the tip of the brush to permit determination of the coarseness or fineness of the bristles.

Figure 4:
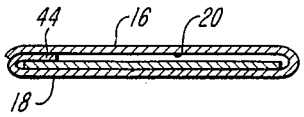
FIG. 4 is a section taken transversely of FIG. 1 on the line 4—4.

The panels 16 and 18 are coextensive in length and breadth and are integrally connected at one edge 40 and adhesively joined at the opposite edge 42 by a flange 44, FIG. 4, extending longitudinally of the back panel 18 which is folded between the panels. The side board **32*b* of the pocket adjacent the edge 40 is provided with a flange 46 which is adhesively attached to the face panel 16. The side board 32*b* of the pocket which is adjacent the edge 42 is formed partly out of the flange 46 and is integrally connected thereto by longitudinally-spaced hinge means 46—46 and contains an opening 48. The adhesively secured edge of the face panel 16 is provided with spaced recesses 50—50 for accommodating the hinge means 46—46 and a tongue 52 intermediate the recesses which extends through the opening 48 and is adhesively secured to the flange 44**.

Figure 8:
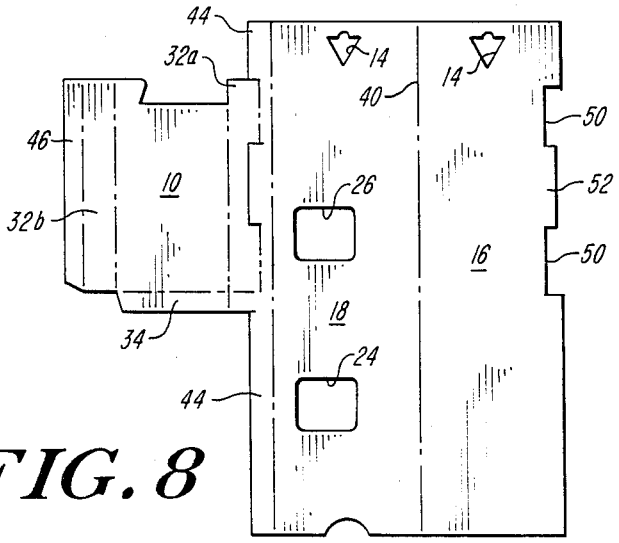
FIG. 8 is a plan view of the information-bearing card.

FIG. 8 is a plan view of a blank die-cut from sheet material and creased to provide the aforesaid structure. As shown, the front panel 16 is integrally connected to the rear panel 18 along a pre-creased hinge. The front panel 16 at its free edge contains cutouts constituting the recesses 50—50, the tongue 52 and one of the openings 14. The back panel 18 contains the sight apertures 24,26, the other opening 14, and the notch 28. At the distal edge of the panel 18, there is provided the attaching flange 44, the face board 10, the side boards **32*a*,32*b*, the attaching flange 46, and the ledge 34**.

The blank is desirably made of a stiff cardboard surface-coated to resist penetration of moisture and paint thinners.

It should be understood that the present disclosure is for the purpose of illustration only and includes all modifications or improvements which fall within the scope of the appended claims.

What is claimed is:

1. A display device for holding paint brushes structured to define a first holder for receiving a brush having a handle and carried by said display device, a second holder for receiving a card bearing instructions for use of the brush, said second holder comprising first and second coextensive, elongate, rectangular panels connected throughout their longitudinal edges to each other to form a mounting means and separable between said edges such as to define a first pocket for slidingly receiving the card, such first holder comprising a third rectangular panel mounted to the face of one of the first and second panels, said third panel being narrower in width and shorter in length than said panels and being positioned with its edges symmetrically spaced from said edges of the panels and with its ends spaced from the ends of the panels with one end at a greater distance than the other from the end of the first and second panels and in spaced parallel relation to the panels so as to define therewith a second pocket for receiving the brush, a ledge at the inner side of the third panel at the lower edge for engagement with the ferrule of the brush to suspend the brush therein and an aperture in the third panel at the top to expose the bristles of the brush for inspection, a portion of said mounting means extending below said ledge for a distance at least as great as the length of said brush handle, and suspending means for suspending said display device for display or storage.

2. A display holder for a paint brush comprising an elongate, flat panel having spaced, side edges and a planar face therebetween, suspending means for displaying said holder for sale and storage of said holder after sale, a structure secured to the planar face intermediate its sides and ends defining, an open-ended pocket dimensioned to receive the bristles of a paint brush with a handle of the brush extending downwardly in front of said planar face, said structure comprising a face board of width no greater than the panel and lesser length than the panel, disposed in spaced, parallel relation to the panel at a distance therefrom corresponding substantially to the thickness of the brush and side boards connected, respectively, to the face board and to the panel, said side boards being of a width corresponding substantially to the thickness of the brush, a ledge interiorly of the structure extending along the lower edge of the face board for engagement with the ferrule of the brush to support the brush within the pocket, the upper end of the face board being spaced from the upper end of the panel such that a portion of the panel extends beyond the face board and contains a means for suspending the holder and the lower end of the face board being spaced from the lower end of the panel such that the portion of the panel below the face board is at least as long as the handle of the brush supported in the pocket, said panel comprising front and back plies joined at their opposite edges such as to define a pocket open at its opposite ends, said back ply containing longitudinally-disposed window openings and a card disposed in said pocket bearing information movable into registration with the window openings such as to enable reading the information borne by the card.

3. A paint brush holder according to claim 2 wherein the holder is comprised of sheet cardboard surface-treated to inhibit penetration of moisture and/or paint thinners.

* * * * *